US005651311A

United States Patent [19]

Lee et al.

[11] Patent Number: 5,651,311

[45] Date of Patent: Jul. 29, 1997

[54] PRINTING PRESS WITH INK SEPARATOR AND METHOD FOR SEPARATING INK FROM DAMPENER SOLUTION

[76] Inventors: John M. Lee, 20599 Primrose Ct., Barrington, Ill. 60010; J. David Brim, 8 Rich Ct., Park Forest, Ill. 60466; Michael J. Studney, 604 S. Oak Park Ave., Oak Park, Ill. 60304

[21] Appl. No.: 98,672

[22] Filed: Jul. 28, 1993

[51] Int. Cl.[6] ..... B41F 7/32; B41F 31/06

[52] U.S. Cl. ..... 101/148; 101/483

[58] Field of Search ..... 101/148, 147, 101/350, 364, 363, 483–485, 207–210; 210/532.1, 537, 538, 540

[56] References Cited

U.S. PATENT DOCUMENTS 3,804,252 4/1974 Rishel ..... 210/84

4,682,542 7/1987 Wieland ..... 101/364 X

*Primary Examiner*—J. Reed Fisher

[57] ABSTRACT

An ink separator (24) in a printing press system (10) having a reservoir (12) for containing dampener solution (14) with a surface (21) and a layer of ink (16) floating on the surface (21) having a pipe (34) within the reservoir (12) with an inlet opening (36) at the surface (21) to drain the dampener solution (14) from the reservoir (12), a member (44) for blocking the entry of ink (16) from the surface (21) into the inlet opening (36) and a passageway (50) extending from beneath the surface (21) to the inlet opening (36) for conveying the dampener solution (14) to the inlet (36).

22 Claims, 3 Drawing Sheets

PRINTING PRESS WITH INK SEPARATOR AND METHOD FOR SEPARATING INK FROM DAMPENER SOLUTION

BACKGROUND OF THE INVENTION

1. Field of The Invention

This invention relates generally to the field of high speed printing presses and, more particularly to such printing presses with dampener solution systems in which dampener solution is collected in dampener solution reservoir pans.

2. Description of the Related Art Including Information Disclosed Under 37 C.F.R Section 1.97–1.99

It is known in a high speed printing press to have separate inking and dampening trains of rollers. The inking train of rollers carry printing ink to the oleophilic and hydrophobic surface of a plate cylinder. The dampening train of rollers carry a dampener solution to the plate cylinder to selectively wash away ink from the nonprinting portions of the plate cylinder surface to form a printing image on the cylinder surface. The dampening train of rollers includes a pickup dampening roller within a dampener solution reservoir pan containing a supply of the dampener solution to remove dampener solution from the reservoir and transfer it throughout the dampening train of rollers.

A consistent distribution of dampener solution throughout the train of dampening rollers is necessary in such printing presses to maintain uniform quality of the printed product. A constant level of dampener solution throughout the reservoir is required to maintain the even distribution of the dampener solution on the pickup roller. It is known to mount a vertical standpipe in the bottom of the dampener reservoir to establish a constant dampener solution level within the reservoir. The liquid in the reservoir above the top of the standpipe drains through the standpipe opening and is removed from the reservoir. Unfortunately, in high speed printing presses the rotating inking rollers often splatter ink throughout the environs of the press. Some of this splattered ink frequently falls into the dampener solution reservoir and thereby contaminates the dampener solution. The splattered ink does not readily mix with the dampener solution; instead, it separates and floats on the surface of the dampener solution much like oil on water.

The contaminant ink on the surface of the dampener solution flows into the standpipe inlet opening and, in turn, clogs the dampener filters and pump mechanisms connected to the standpipe outlet. Disadvantageously, once the filter is clogged the level of the dampener solution rises and the printing press system must be shut down to clean or replace the expensive filters or pump mechanisms. Furthermore, a system shut down due to blockage in the dampener solution outlet lines reduces the circulation of the dampener solution in the reservoir causing the solution to stagnate. Stagnant dampener solution in a high speed printing press increases the temperature of the solution thereby changing the acidic, PH, and alkaline levels of the dampener solution. These uncontrolled changes in the chemical properties in the dampening solution adversely effect the ink viscosity at the plate cylinder decreases the quality of the printed product.

In known high speed printers, an attempt to limit the amount of contaminant ink draining into the standpipe opening has been made by means of specially shaped reservoir pans with welded baffles used to separate the accumulated ink from the dampener solution and reduce the amount of contaminant adjacent the inlet of the standpipe. Disadvantageously, even though these special baffled pans are expensive, they can only prevent a portion of the ink from draining out through the standpipe. Some of the ink on the surface migrates throughout the reservoir despite the baffles, and the baffles thereby allow a significant amount of ink to disadvantageously flow through the standpipe and into the filtering system.

SUMMARY OF THE INVENTION

It is therefore the principal object of the present invention to provide a high speed printer with an ink separator and method of separating ink from dampener solution in a dampener solution reservoir to prevent entry of substantially all ink into the dampener solution filtering system to overcome the problems resulting from ink clogged filters and pumps noted above.

This object is achieved by providing a printing press having a reservoir for containing dampener solution with a surface and a layer of ink floating on the surface, with an ink separator comprising a pipe within the reservoir and having an inlet opening at a preselected surface level to drain the dampener solution from the reservoir, means for preventing the entry of the layer of ink floating on the surface into the inlet including a member for substantially blocking the entry of ink from the surface level into the inlet opening and means for conveying dampener solution to the inlet including a passageway extending from beneath the surface level to the inlet opening.

Also, the object of the invention is achieved in a printing press having a reservoir for containing a dampener solution with a surface at a preselected level and a layer of ink floating on the surface, by provision of a method of separating the ink from the dampener solution comprising the steps of (a) draining a dampener solution from a reservoir with a pipe having an inlet opening at a preselected surface level, (b) substantially blocking the entry of ink from the preselected surface level into the inlet opening and (c) conveying dampener solution from beneath the surface level to the inlet opening.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
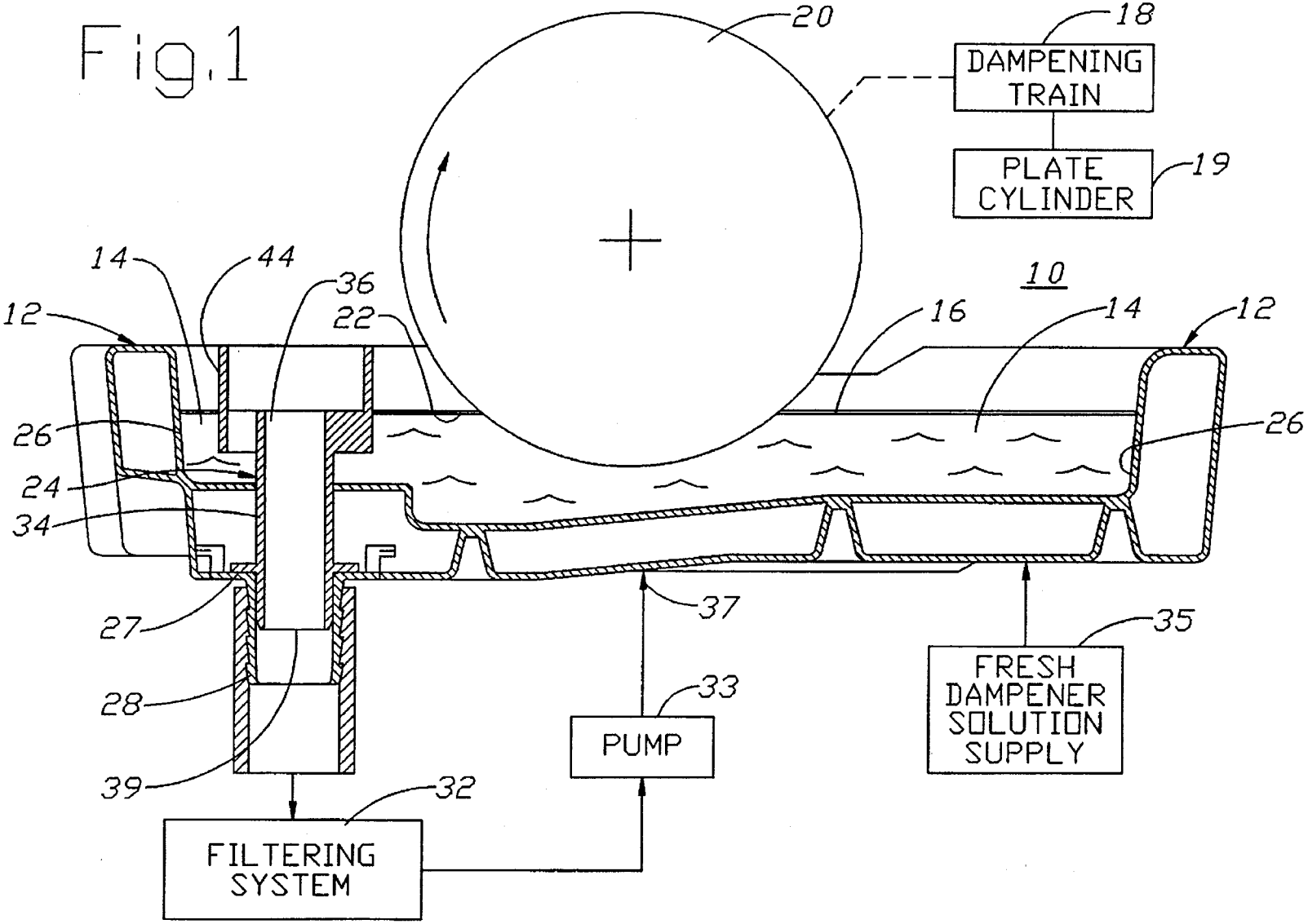
FIG. 1 is a illustration of the preferred embodiment of high speed printing partially in a functional block form and showing a cross sectional view of the preferred form ink separator of the present invention.
Figure 2:
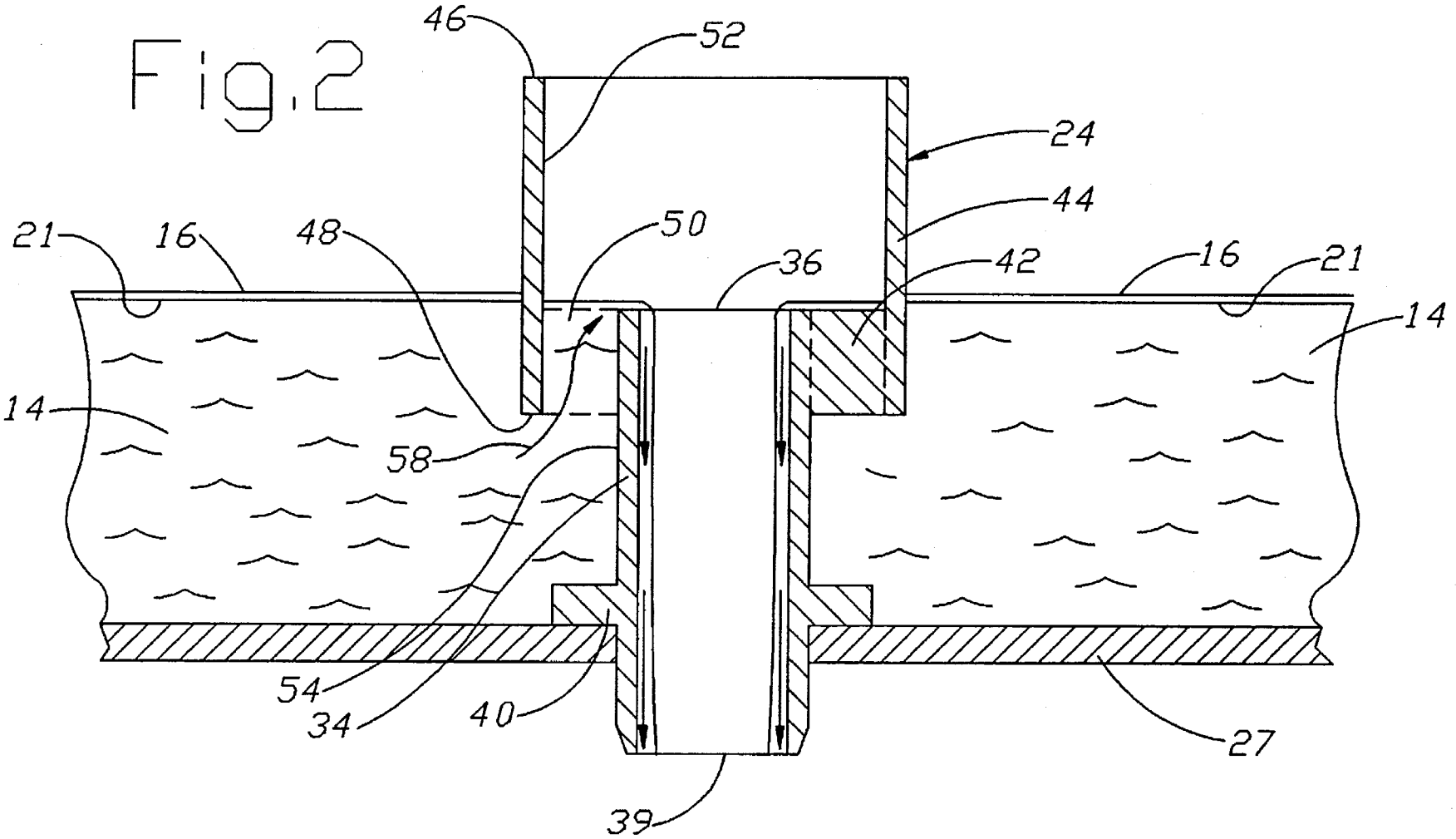
FIG. 2 is an enlarged cross sectional view of the ink separator within the dampening solution reservoir of FIG. 1.

Referring now to FIG. 1, the preferred embodiment of the printing press 10 has a reservoir 12 containing dampener solution 14 with a layer of ink 16, FIG. 2, on the surface of the dampener solution 14. The printing press 10, FIG. 1, includes a rotating dampening roller 20 within the reservoir 12 for the removal of dampener solution 14 from the reservoir 12 and a dampening train of rollers 18 in rolling contact with the dampening roller 20 to distribute dampener solution 14 through the remainder of the printing press 10 including the plate cylinder 19. For an explanation of the details of the remainder of the printing press 10, reference should be made to U.S. Pat. No. 4,864,925 issued Sep. 12, 1989 to Van Kanegan et al.

The dampening solution 14 is maintained at a preselected level 22 and is drained through the ink separator 24 of the present invention and a filtering system 32. In some systems, a pump 33 and a recycling input 37 coupled to the reservoir 12 are provided to recycle and return the drained dampener solution 14 to the reservoir. Fresh dampener solution 14 from a fresh dampener solution supply 35 is also added to the reservoir 12 to make up the difference of that which is lost to the remainder of the press 10 during operation to maintain the preselected level 22. The preselected level 22 is maintained at a fixed point by the ink separator 24 to ensure an even flow of dampener solution 14 throughout the printing press system 10.

The reservoir 12 has four interconnected side walls 26 (only three shown) and a bottom 27 with an outlet drain spigot 28 to convey drained dampener solution 14 to the filtering system 32 for removal. Still referring to FIG. 1, the preferred embodiment of the ink separator 24 has an inner drain pipe 34 with an inlet opening 36 at the preselected level 22 and an outlet 39 received within the outlet drain spigot 28 and a blocking member 44 surrounding the inner drain pipe adjacent the inlet opening 36.

Referring also to FIG. 2, the ink separator 24 during use is partially submerged in the dampener solution 14. Ink 16 splattered from the printing press system 10, FIG. 1, that falls into the reservoir 12 floats on the surface 21, FIG. 2, of the dampener solution 14. The blocking member 44 protectively surrounds the inlet opening to prevent the entry of the layer of ink 16 floating on the surface 21 into the inlet opening 36 of the inner drain pipe 34. The blocking member 44 preferably has a wall closed by means of which the entry of virtually all the ink 16 on the preselected surface level 21 is blocked from flowing into the inlet opening 36.

An annular passageway 50 formed between the inner drain pipe and the portion of the blocking member extends from beneath the surface level 21 to the inlet opening 36. The contaminant free dampener solution 14 from beneath the surface level 21 and the surface layer 16 of contaminated ink passes through the annular passageway 50. The passageway 50 extends laterally between the interior side wall 52 of the blocking member 44 and the spaced exterior side walls 54 of the inner drain pipe 34 and is thereby conveyed to the inlet opening 36 for removal from the reservoir 12.

An annular collar 40 carried by the pipe 34 between inlet 36 and the bottom 39 of the blocking member 44 abuts the reservoir bottom 27 to position the blocking member 44 in a preselected spaced relation, or level, relative to the reservoir bottom 27. The relative position of the inlet opening 36 is likewise provided by collar 40, since connection members 42 mount the blocking member 44 to the inner drain pipe 34 with the blocking member top 46 and blocking member bottom 48 at opposite sides of the inlet opening 36 in fixed position relative to the inlet opening. The top 46 of the blocking member 44 is located substantially above the preselected surface level 21 of the dampener solution 14, as determined by level of the inlet opening 36, and the bottom 48 is located substantially below the inlet opening 36. Preferably, the top 46 is closer than the bottom 48 to the inlet opening 36 for maximum protection above the service level 21. In this way the ink 16 floating on the surface level is blocked away from the inlet opening while also allowing noncontaminated dampener solution 14 from beneath the surface 21 to flow through the passageway 50 and into and down the inner drain pipe 34, regardless of temporary fluctuations in level 21. The dampener solution 14 flows through the passageway 50 in the direction of arrow 58. Preferably, the blocking member 44 is open at last partially at its top end 46 to allow the interior of the blocking member to vent to the atmosphere or is otherwise vented to enable dampener solution to rise upwardly into the passageway 50.

Figure 3A:
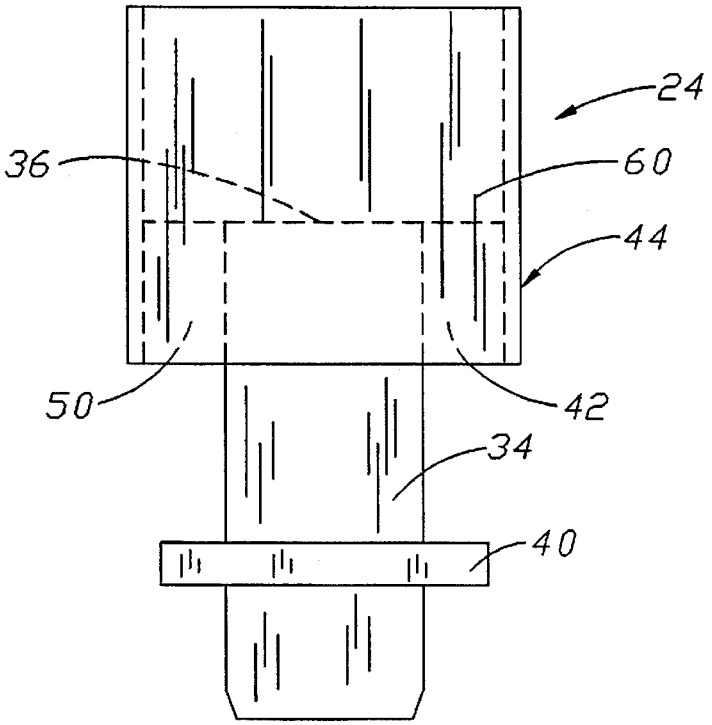
FIG. 3A is an enlarged side view of the ink separator of FIG. 2 apart from the reservoir.
Figure 3B:
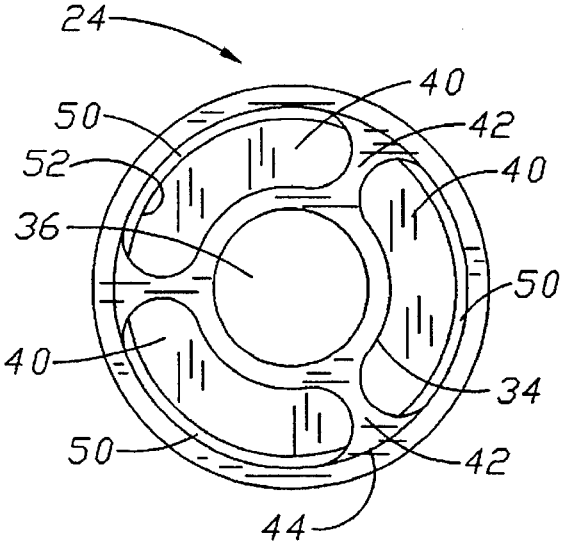
FIG. 3B is a top view of the ink separator of FIG. 3A.
Figure 3C:
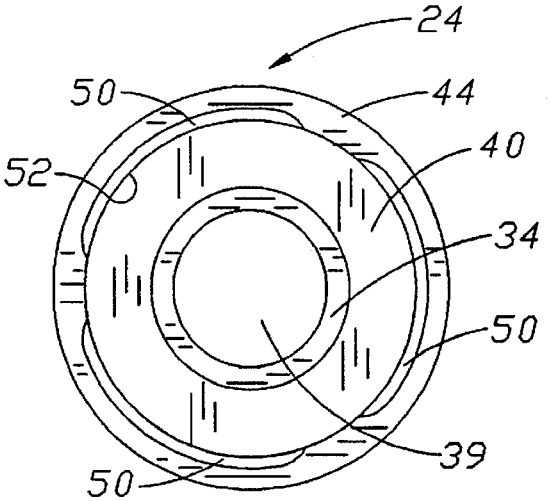
FIG. 3C is a bottom view of the ink separator of FIG. 3A.

Referring to FIG. 3A, the ink separator 24 with the collar 40 and the blocking member 44 are mounted to the inner drain pipe 34. Preferably, the pipe 34 and the blocking member 44 are integrally formed, and the blocking member 44 has a cylindrical tubular body 60 which surrounds the inlet opening 36 of the pipe 34. Referring to FIG. 3B, inlet opening 36 of the inner drain pipe 34 is preferably centrally located and surrounded by the blocking member 44. Preferably, three connection members 42 symmetrically mount the blocking member 44 to the pipe 34. The collar 40 also surrounding the pipe 34 has a diameter smaller than that of the interior surface 52 of the blocking member 44. Referring now to FIG. 3C, the outlet 39 of the ink separator is defined by the end opening of inner drain pipe 34. The inner drain pipe 34 is surrounded by the collar 40 and the cylindrical blocking member 44.

The advantages of the invention are preferably obtained with the printing press 10 having a reservoir 12 for containing a dampener solution 14 with a surface at a preselected level 21 with a layer of ink 16 at the surface and with the preferred embodiment of the separator 24 as described above with reference to FIGS. 1–3C. However, the preferred method of the invention for separating contaminant ink from dampener solution is not limited to the preferred structure of the preferred embodiment. The preferred method comprises the steps of (1) draining a dampener solution from a reservoir with a pipe having an inlet opening at a preselected surface level, (2) substantially preventing the entry of ink from the surface level into the inlet opening, and (3) conveying the dampener solution from beneath the surface level to the inlet opening.

Separating the ink 16, FIG. 1, from the dampener solution 14 is preferably performed by surrounding the inlet opening 36 with the blocking member 44 to prevent the ink from traveling down the inner drain pipe 34. The draining of the dampener solution 14 by the ink separator 24 is performed by the pipe 34 preferably at a location which is spaced from the side walls 26 of the reservoir 12. Alternatively, the pipe is formed into or as part of the side walls. The blocking member 44 performs the step of preventing the entry of ink 16 from above the surface level 21 into the inlet opening 36 of the pipe, since it extends from below the preselected surface level 21 of the dampener solution 14 to above the preselected surface level. The dampener solution 14 is conveyed from beneath the surface level 21 to the inlet opening 36 by passing the dampener solution through the passageway openings 50 defined by the blocking member 44 and the inner drain pipe 34. Preventing the ink 16 from entering the inlet opening 36 of the pipe 34 is accomplished in part by mounting the inlet opening at the preselected surface level 21 and mounting the blocking member 44 in a preselected spaced relationship with the inlet opening to block the entry of ink on the surface into the inlet.

While a detailed description of the preferred embodiment of the invention has been given, it should be appreciated that many variations can be made thereto without departing from the scope of the invention as set forth in the appended claims. For instance, it is contemplated that multiple separators be used in a single reservoir, the collar 40 be adjustably mounted to the interior drain pipe 34 for different sized reservoirs and the pipe be integrally formed with or made part of the side walls of the reservoir or that other means for forming a passageway be employed.

We claim:

1. In a printing press having a reservoir with a bottom for containing dampener solution with a surface and a layer of ink floating on the surface, the improvement being an ink separator, comprising:

a pipe within the reservoir and having an inlet opening positioned substantially above the bottom of the reservoir at a preselected level to drain the dampener solution from the reservoir only when the surface is above said preselected level;

means for preventing the entry of the layer of ink floating on the surface into the inlet opening including a member for substantially blocking the entry of ink from the surface into the inlet opening; and means for conveying dampener solution to the inlet including a passageway extending upwardly from beneath the preselected level to the inlet opening positioned substantially above the bottom of the reservoir.

2. The printing press of claim 1 including means carried by the pipe for mounting the blocking member in a preselected spaced relationship relative to the reservoir.

3. The printing press of claim 2 in which the blocking member mounting means includes means for mounting the blocking member to the pipe in a relationship with the inlet.

4. The printing press of claim 3 in which the blocking member mounting means includes a collar around the pipe.

5. The printing press of claim 2 in which the blocking member mounting means includes a collar around the pipe.

6. The ink separator of claim 1 in which the blocking member has a bottom and a top, and the preventing means includes means for mounting the blocking member with the bottom and top on opposite sides of the inlet opening.

7. The printing press of claim 1 including means for mounting the blocking member to the pipe.

8. The printing press of claim 1 in which the blocking member and the pipe are integral.

9. The printing press of claim 1 in which the blocking member has a top located substantially above the preselected surface level of the inlet opening.

10. The printing press of claim 1 in which the blocking member has a bottom located substantially below the inlet opening.

11. The printing press of claim 8 in which the top end of the blocking member has an interior above the preselected surface, and including means for venting the interior to atmosphere.

12. The printing press of claim 1 in which the blocking member has a tubular body which substantially surrounds the inlet opening of the pipe.

13. The printing press of claim 1 in which both the pipe and the blocking member are substantially cylindrical and symmetrically mounted relative to each other.

14. The printing press of claim 1 in which the reservoir has a plurality of side walls, and means for mounting the blocking member at a location spaced from all the side walls.

15. The printing press of claim 1 in which both the pipe and the blocking member have opposed side walls spaced from each other to form the passageway.

16. The printing press of claim 1 in which the passageway substantially surrounds the pipe.

17. In a printing press having a reservoir with a bottom for containing a dampener solution with a surface at a preselected level and a layer of ink floating on the surface, the improvement being a method of separating the ink from the dampener solution, comprising the steps of:

draining a dampener solution from a reservoir with a pipe having an inlet opening positioned above the bottom of the reservoir at a preselected surface level;

substantially preventing the entry of ink from the preselected surface level into the inlet opening; and conveying dampener solution from beneath the surface level to the inlet opening positioned above the bottom of the reservoir.

18. The ink separating method of claim 17 in which the step of substantially preventing the entry of ink includes the step of substantially surrounding the inlet opening with a blocking member.

19. The ink separating method of claim 17 in which the reservoir has a plurality of side walls and the step of draining is performed by the pipe at a location spaced from the side walls.

20. The ink separating method of claim 17 including the step of substantially preventing the entry of ink from above the surface level into the inlet opening with a blocking member extending from below the preselected surface level to above the preselected surface level.

21. The ink separating method of claim 17 in which the step of conveying dampener solution includes the step of passing dampener through a passageway defined at least in part by a blocking member employed to perform the step of preventing.

22. The ink separating method of claim 17 in which the step of preventing includes the steps of mounting the inlet opening at the preselected surface level, and mounting a blocking member in a preselected spaced relationship with the inlet opening to block the entry of ink on the surface into the inlet.

* * * * *